US009784428B2

(12) United States Patent
Bergenek et al.

(10) Patent No.: US 9,784,428 B2
(45) Date of Patent: Oct. 10, 2017

(54) LIGHTING DEVICE WITH OPTOELECTRONIC LIGHT SOURCE

(71) Applicant: OSRAM GmbH, Munich (DE)

(72) Inventors: Krister Bergenek, Regensburg (DE); Florian Boesl, Regensburg (DE); Andreas Dobner, Wenzenbach (DE); Katrin Kondula, Regensburg (DE); Reiner Windisch, Pettendorf (DE); Dennis Sprenger, Roethenbach an der Pegnitz (DE); Meik Weckbecker, Thalmassing (DE)

(73) Assignee: OSRAM GmbH, Munich (DE)

( * ) Notice: Subject to any disclaimer, the term of this patent is extended or adjusted under 35 U.S.C. 154(b) by 211 days.

(21) Appl. No.: 14/793,765

(22) Filed: Jul. 8, 2015

(65) Prior Publication Data

US 2016/0010828 A1 Jan. 14, 2016

(30) Foreign Application Priority Data

Jul. 9, 2014 (DE) ..... 10 2014 213 380

(51) Int. Cl.

| | |
|---|---|
| ***F21V 5/00*** | (2015.01) |
| ***F21V 5/04*** | (2006.01) |
| ***F21V 13/04*** | (2006.01) |
| *F21V 7/00* | (2006.01) |
| *F21Y 115/10* | (2016.01) |

(52) U.S. Cl.

CPC ..... *F21V 5/008* (2013.01); *F21V 5/046* (2013.01); *F21V 13/04* (2013.01); *F21V 7/0066* (2013.01); *F21Y 2115/10* (2016.08)

(58) Field of Classification Search

CPC ..... F21V 5/008; F21V 13/04; F21V 5/046; F21V 7/0066; F21Y 2115/10

See application file for complete search history.

(56) References Cited

U.S. PATENT DOCUMENTS

| | | | | |
|---|---|---|---|---|
| 6,679,621 | B2 | 1/2004 | West et al. | |
| 2013/0201425 | A1* | 8/2013 | Matsuki | F21V 5/007 349/64 |

FOREIGN PATENT DOCUMENTS

| | | | |
|---|---|---|---|
| DE | 4204953 | A1 | 8/1993 |
| EP | 1028348 | A1 | 8/2000 |
| FR | 2737162 | A1 | 1/1997 |
| WO | 2005/047764 | A1 | 5/2005 |

OTHER PUBLICATIONS

German Search Report based on appliction No. 10 2014 213 380.7 (8 pages) dated Jan. 30, 2015 (for reference purpose only).

* cited by examiner

*Primary Examiner* — Donald Raleigh
*Assistant Examiner* — Kevin Quarterman
(74) *Attorney, Agent, or Firm* — Viering, Jentschura & Partner mbB

(57) ABSTRACT

Various embodiments relate to a lighting device with an optoelectronic light source, an optical body downstream thereof for distributing the light, and a diffuser downstream of the latter, onto the light entry surface of which the light emitted by the optical body falls and the light exit surface of which represents a light emission surface of the lighting device. To homogenize the luminous intensity on the light exit surface, in addition to distributing the light with the optical body, the diffuser is not provided to be uniformly scattering to such an extent that light falling thereon in a central region is scattered more intensely than light falling thereon in an edge region.

15 Claims, 3 Drawing Sheets

LIGHTING DEVICE WITH OPTOELECTRONIC LIGHT SOURCE

CROSS-REFERENCE TO RELATED APPLICATION

This application claims priority to German Patent Application Serial No. 10 2014 213 380.7, which was filed Jul. 9, 2014, and is incorporated herein by reference in its entirety.

TECHNICAL FIELD

Various embodiments relate generally to a lighting device with an optoelectronic light source for the emission of light.

BACKGROUND

The effects which lighting devices based on optoelectronics have over conventional incandescent or fluorescent lamps, for example relating to energy efficiency or service life, are known. However, one challenge may consist in adapting the light typically output in a directed manner from the optoelectronic light source in such a way that a desired emission characteristic in the near field and/or a desired luminous intensity distribution on a light exit surface of the lighting device result(s).

SUMMARY

Various embodiments relate to a lighting device with an optoelectronic light source, an optical body downstream thereof for distributing the light, and a diffuser downstream of the latter, onto the light entry surface of which the light emitted by the optical body falls and the light exit surface of which represents a light emission surface of the lighting device. To homogenize the luminous intensity on the light exit surface, in addition to distributing the light with the optical body, the diffuser is not provided to be uniformly scattering to such an extent that light falling thereon in a central region is scattered more intensely than light falling thereon in an edge region.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
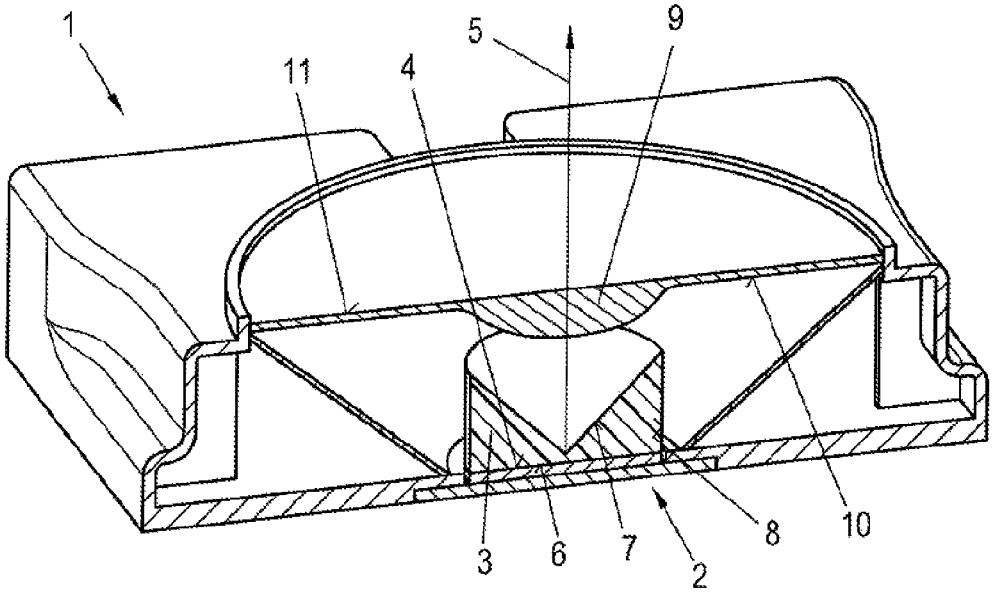
FIG. 1 shows a lighting device according to various embodiments in a sectioned oblique view.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments specify a lighting device with an optoelectronic light source.

In various embodiments, a lighting device is provided with an optoelectronic light source which is designed for the emission of light around a main beam, an at least partially translucent (preferably transparent) optical body for distributing the light, and a diffusely scattering diffuser having a light entry surface and a light exit surface. The optical body is provided and arranged in such a way that at least a large part of the light emitted by the optoelectronic light source passes through the optical body, part of this light being distributed toward the side, and the diffuser being provided with an inert scattering means and being arranged relative to the light source and the optical body such that

- its thickness, measured in the direction of the main beam, is smaller than its respective lateral extents which are respectively measured from the main beam at right angles to the latter,
- at least a large part of the light that has emerged from the optical body falls on the light entry surface (not necessarily directly, possibly also following prior reflection on a lighting device reflection surface), passes through the diffuser and emerges from the diffuser at the light exit surface,
- the average scattering of light which falls onto the light entry surface in the inner 50% of the respective side extent is at least 10% greater than the average scattering of light which falls on the light entry surface in the outer 50% of the respective side extent, and
- at least light which falls onto the light entry surface in the outer 20% of a respective side extent is scattered in a location-independent manner.

In order to homogenize the luminous intensity distribution on the light exit surface of the diffuser and therefore the light exit surface of the lighting device as far as possible, two measures are therefore combined, in various embodiments. If a typical Lambertian emission characteristic having a maximum luminous intensity along and immediately around the main beam is assumed, firstly a certain distribution of the light toward the side is achieved with the optical body. Secondly, however, the light distribution is not corrected by the optical body to such an extent that the luminous intensity distribution would largely already be homogenized on the light entry surface of the diffuser; instead a certain inhomogeneity is accepted on the light entry surface of the diffuser and corrected via location-dependent, different scattering properties of the diffuser.

Figure 3:
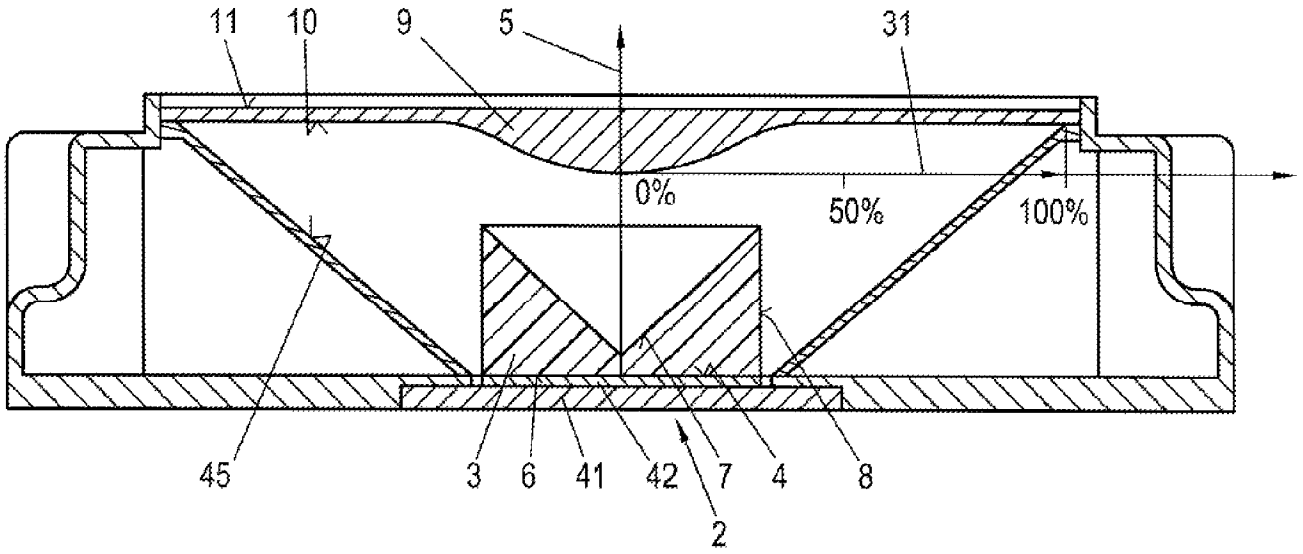
FIG. 3 shows a lighting device according to various embodiments in a sectioned side view.

This is because it would otherwise be necessary for a homogeneous luminous intensity distribution to be established solely via the optical body; the optical body would have to have a relatively large height (measured in the direction of the main beam), which would enlarge the installation height of the lighting device overall, although this is also generally disadvantageous in the case of recessed lights. One reason for the greater overall installation height would be that, for example, an appropriate total reflection surface or exit refraction surface would have to run relatively flat in relation to the main beam in order to distribute as much light as possible away from the main beam toward the side. In FIG. 3, therefore, for example the "funnel" forming the reflection surface in the optical body would have to be elongated in the direction of the main beam and the optical body would have to be accordingly high.

If, on the other hand, the homogenization of the luminous intensity on the light exit surface of the diffuser were to be established solely via different scattering, said diffuser would become so large overall that the efficiency would be considerably reduced by scattering losses. Since, now, light is already distributed toward the side by the optical body, the diffuser can even be provided so as to scatter location-independently in the edge region, that is to say in the preferred case of the scattering particles embedded in the diffuser and distributed uniformly in the latter, constantly thin, therefore with a constant minimum thickness.

The light falling onto the light entry surface in the outer 20% of a respective side extent (between 80% and 100%) should therefore be scattered location-independently (and as little as possible), which may be intended to be true e.g. in this order for the outer 30%, 40% and 50%, respectively; here, the statements are respectively to be viewed as minimum statements; the area of location-independent scattering can therefore also respectively reach somewhat further inward (hence the formulation "at least light"). In summary, the feature combination according to various embodiments therefore permits a lighting device to be configured firstly compactly and secondly equally energy efficiently.

"At least a large part" of the light emitted by the light source passes through the optical body, e.g. more than 80%, 90% or 95%, e.g. all of the light. Likewise, "at least a large part" of the light that has emerged from the optical body also falls on the light entry surface and these percentages are intended also to be disclosed in this regard. For reasons of efficiency, it may be provided for all of the light to fall on the light entry surface, within the context of the technical possibilities. The distribution of the light by the optical body "toward the side" means that the light downstream of the optical body (when light source and optical body are viewed on their own) exhibits a luminous intensity distribution which, e.g. even at polar angles from +/−90° (starting from the main beam as 0° axis), has a luminous intensity or an increased luminous intensity (in the case of an originally Lambertian emission characteristic, it is equal to zero there).

The direction of the "main beam" results from a "main emission direction" of the light source and has its base point in the "center" of the light emission surface(s) of the latter. The "main emission direction" results as the average of all the direction vectors along which the light source emits; during this averaging each direction vector is weighted with the luminous intensity assigned thereto. Each direction in which a light source emits can be described as a vector, which can be assigned a luminous intensity. The center of the area of the light source is designated as the "center" of its light emission surface(s).

For example, in the case of an LED module as light source, which is provided from a multiplicity of LEDs jointly covered with an at least partly translucent filling material, the light emission surface of the light source is located on the side of the filling material opposite the LEDs. The center of its area, for example in the case of an exemplary circular geometry, results as the center of the circle, and the main beam then extends away from the LED module at right angles to the light emission surface and has its base in the center of the circle. In general, in the case of a Lambertian emission characteristic, the main emission direction is located at right angles to a light emission surface which is then typically planar.

Once more in relation to the combination of optical body and diffuser: to a certain extent, two different mechanisms of action are also therefore combined, specifically firstly adaptation of the light distribution by reflection or refraction in the optical body, that is to say with a structure which can be described within the context of the geometric beam optics. Secondly, the adaptation in the diffuser is carried out by diffuse scattering, the directions in which scattering takes place being randomly distributed (in any case when viewed macroscopically, in which each scattering center is not modeled individually). Between the optical body and the diffuser, the light that has emerged from the optical body e.g. passes through an air space.

In the main claim, the location-dependent different scattering is described functionally, since it can be achieved in different ways. Preference is given to a diffuser having scattering particles distributed uniformly therein, the thickness of which (the thickness of the diffuser) is set as a function of the desired scattering, that is to say thicker in the middle and then constantly thin at the edge. However, the scattering means provided can also be a coating and/or roughening of the light entry and/or light exit surface. In the case of the coating, for example, scattering particles can be provided in a variable concentration in a continuous layer and/or a layer that is interrupted in some sections in order to establish the desired scattering can be applied, e.g. then with scattering particles distributed uniformly therein. In the case of surface roughening, this can be more intense in the middle and constantly weak at the edge.

The scattering specified functionally in view of these various possibilities is described with reference to the respective "lateral extent". This is measured away from the main beam, and therefore has its 0% value there. Furthermore, the lateral extent by definition relates to the region of the light entry surface through which the light from the light source shines; therefore, for example, an edge region that is used for fixing the diffuser and through which light does not pass should be disregarded. Expressed in another way, the area of the light entry surface through which light shines is therefore bounded by a 100% line running around the main beam, and respective percentage portions can be determined through the straight-line connecting sections from the 0% value (from the main beam) to the 100% line.

In the inner 50% of a respective lateral extent, the average scattering of the (light just falling on the aforesaid inner 50% of the lateral extent) is intended to be at least 10%, e.g. in this order e.g. at least 20%, 30%, 40% and 50%, greater than that in the outer 50% of the respective lateral extent.

If the "respective" lateral extent is mentioned, this e.g. relates to all the lateral extents; a corresponding configuration is therefore provided circumferentially.

The "average scattering" results from averaging over an appropriate surface area which results on the basis of mutually corresponding portions of the respective lateral extents (for example from 0% to 50% or from 50% to 100%), integrated over one revolution around the main body. In the case of a circular light entry surface, the respective surface area therefore results, for example, as the area over which a corresponding portion of a single respective lateral extent sweeps during the rotation through 360° about the main beam, that is to say a circular area (0% to 50%) or annular circular area (50% to 100%).

If, within the context of this disclosure, mention is made of "scattering" which is more intense or is weaker, this relates to a correspondingly varying scattering coefficient; the intention is therefore for the average scattering coefficient in the central region (0% to 50%) to be correspondingly larger than in the outer region (50% to 100%), and for the scattering coefficient to be constant (small) in the edge region (80% to 100%). All statements relating to "scattering" are intended to be read expressly as a "scattering coefficient" and disclosed in this form. The scattering can be determined, for example, as the ratio of illumination intensity at the light entry surface to illumination intensity at the light exit surface, in each case measured in the same lateral and rotational extent (which can be infinitesimally small); it is therefore a matter of the extent to which the light that is incident in one area of the light entry surface is attenuated (by scattering).

The "optoelectronic light source" is at least one "optoelectronic component"; in general, this can be an LED chip that has already intrinsically been housed, so that the light source would be built up from a multiplicity of intrinsically housed LED chips. However, the exemplary light source is an LED module, therefore a multiplicity of jointly housed LED chips, which are therefore arranged, for example, on a common carrier plate and jointly covered with a filling material, for example a potting material, e.g. with silicone.

The "optical body" can generally also be provided of glass; however, a plastic material may be provided, for example polycarbonate, polymethyl methacrylate or silicone. Various embodiments may provide a production by casting in a mold, e.g. by injection molding. If, for the light distribution, the optical body has a total reflection surface, for example, one effect of the latter may consist, for example, in the fact that no further surface coating has to be applied for the purpose of mirror coating, instead the total reflection surface is "produced at the same time" as a result of the geometry during production. In addition, the total reflection can also offer efficiency advantages, for example.

Further various embodiments will be found in the dependent claims and in the following description; in the illustration a distinction is also not always drawn individually between device and method or use aspects; in any case the disclosure with regard to all the categories of claims is to be read implicitly.

In various embodiments, the diffuser is provided such that the scattering of the light decreases away from the main beam, the course of the scattering being continuous and smooth. There are therefore no steps between areas of different scattering, by which, on the light exit surface side, a particularly homogeneous course of the luminous intensity can be achieved. In the exemplary case of the diffuser of varying thickness, the thickness just has a corresponding course.

In relation to the further description of an exemplary diffuser, reference is made below to an "optical body projection area", which results from a projection of the optical body onto the light entry surface in the direction of the main beam. This projection area creates a reference system, and the intention is for the average scattering of light falling thereon to be at least 10% greater than the average scattering of light falling on the light entry surface from outside the projection area; with regard to further exemplary percentages, reference is made to the above disclosure relating to the ratio of the average scattering in the inner 50% and the outer 50% of the lateral extent. In other words, the optical body may be provided such that its projection area lies within the inner 50% of the respective lateral extents.

It has already become clear from the above explanations that the scattering in the edge region is intended to be location-independent and, in a central region, scattering takes place in a location-dependent manner. The first-named region will be designated as the "transmission region" below, and the last-named as the "adaptation region". In various embodiments, the adaptation region is now either congruent with the optic body projection area or the two behave like a superset and subset; therefore either the adaptation region lies completely in the projection area, which is somewhat larger in this case, or the projection area lies completely in the adaptation region, which is somewhat larger in this case, the last-named variant being an example. If the adaptation region and the projection area are not congruent and, accordingly, they have a different area content, the area contents thereof should deviate from one another by at most 15%, e.g. at most 10%, e.g. at most 5% (in each case based on the smaller area).

In simplified terms, the intention is therefore substantially for scattering to take place in a location-dependent manner where the optical body is arranged opposite the main beam, viewed through the diffuser. In the region of location-dependent scattering, the scattering can generally also have a step-like course, it therefore being possible for there to be sub-regions having location-independent scattering; however, the scattering referred to above, which runs continuously and smoothly, may be provided.

In various embodiments, the scattering means provided are scattering particles embedded in the diffuser, that is to say in the volume material of the latter, for example aluminum oxide and/or titanium dioxide particles. In general, a course of the scattering coefficients as described above can also be established here, for example, via the concentration of the scattering particles; more scattering particles per unit volume can therefore be provided, for example, in the central region around the main beam. To this extent, for example, production in a multi-stage filling method is conceivable, for example the central region of high scattering particle concentration being cast first and the intermediate region and edge region then being molded on.

In various embodiments, however, in the case of the scattering particles embedded in the diffuser, the scattering is established via the thickness of the diffuser, e.g. solely via the thickness, that is to say with a constant scattering particle concentration. This can simplify the production to the extent that one mold can predefine the changing thickness and the diffuser can thus also be cast in a single step.

Production by casting may be provided, e.g. by injection molding. In general, also irrespective of the specific production method, the diffuser may be provided from a plastic material, for example from polycarbonate and/or polymethyl methacrylate.

In the case of the diffuser with scattering particles embedded therein and of variable thickness, the average thickness of the diffuser in the inner 50% of the lateral extent (0% to 50%) is greater than the average diffuser thickness in the outer 50%, i.e. from 50% to 100%. In a way analogous to the above considerations of the average scattering, an average (of the thickness) which relates to a region that results from the percentage lateral extent and rotation is considered here.

In various embodiments, a percentage change in the scattering and/or a percentage increase or decrease in the scattering, specified above, is established solely by a thickness fluctuation proportional thereto, and the intention is for all of the percentage statements made with regard to scattering also to be disclosed with regard to a corresponding average thickness or thickness change. To this extent, the average scattering corresponds to the average thickness in the respective region, and the increase or the decrease in the thickness is considered in a way analogous to the scattering in the section plane(s) containing the main beam. In various embodiments, in the case of a diffuser having scattering set via the thickness, but also in general, the light exit surface may be of planar form. In the first-named case (thickness fluctuation), the light entry surface is therefore provided as curved with respect to a plane perpendicular to the main beam.

In the following, various embodiments of the diffuser will be described, to be specific once more with reference to a respective lateral extent and the scattering (which is preferably to be read as to the thickness). In various embodiments, the scattering of light which falls onto the light entry surface in the inner 15% of the lateral extent should decrease by at most 15%, e.g. at most 12.5% or 10% (from 0% to 15% of the lateral extent). Centrally, the scattering should therefore be high and decrease only little. In various embodiments, the scattering of light which falls onto the light entry surface in a region from 20% to 50% of the lateral extent should decrease by at least 50%, e.g. by at least 60% or 70% (in each case from 20% to 50% of the lateral extent). In this region, the scattering should therefore decrease relatively highly. In various embodiments, the average scattering of light which falls onto the light entry surface in the outer 20% of the lateral extent should be at least 50%, e.g. at least 60% or 70%, lower than the average scattering of light which falls onto the light entry surface in the inner 15% of the lateral extent. Thus, the location-independent "small" scattering in the edge region, for example, can therefore be quantified.

In the following, the optical body will further be described in detail, specifically initially via the emission characteristic, i.e. the light distribution which the light has downstream of the optical body. In this case, only the optical body and the light source will be taken into account, therefore the remainder of the lighting device, for example the diffuser and a reflector that may be provided, will be disregarded. The light emitted by the light source and shaped by the optical body should have a light distribution downstream of the optical body which, starting from the main beam as 0° axis, has a maximum value in a polar angular range between −60° and 60°. In addition—which is also just an indicator of the distribution "toward the side"—the luminous intensity at −90° and 90° should not be equal to 0 (otherwise than in the case of Lambert emission), and specifically should make up at least 10%, e.g. at least 20%, e.g. at least 25%, of the maximum value. On the other hand, with regard to the overall system, an upward limitation of the luminous intensity at +/−90° may be advantageous, and the luminous intensity there should make up at most 60%, e.g. at most 50%, e.g. at most 40%, of the maximum value. In simplified terms, therefore, not too much light should be distributed toward the side, since otherwise it might possibly be necessary for the diffuser to scatter and compensate more highly in the edge region, which could make the efficiency worse. The "polar angle" referred to is the angle between the respective emission direction and the main beam. The light distribution can be illustrated, for example, by luminous intensity distribution curves which, for viewing in two dimensions, are measured in respectively one plane containing the main beam and, starting from the latter as 0° axis, illustrate the luminous intensity up to +/−180° (cf. FIG. 2).

Various embodiments relate to the attachment of the optical body to the light source, i.e. in practical terms to the light emission surface of the latter. Direct optical contact may be provided, so that if need be the light between light emission surface and optical body light entry surface therefore passes through an intermediate material with a refractive index $n_{zw}>1.2$. The optical body can therefore either be molded on directly (hence "if need be") or, by way of example, an intermediate layer made of an appropriate intermediate material can be provided.

The refractive index $n_{Hk}$ of the filling material (from which the enveloping body covering the LEDs is provided) and the refractive index nok of the optical body material forming the optical body normally lie in a range $1.3 \leq n_{Hk}/n_{Ok} \leq 1.7$, e.g. $1.4 \leq n_{Hk}/n_{Ok} \leq 1.6$, where e.g. $n_{Ok}>n_{Hk}$. If, then, if need be, an intermediate material with $n_{zw} \geq 1.2$, e.g. in this order ≥1.25, ≥1.3, ≥1.35 or ≥1.4, is provided, refractions are at least reduced. Possible upper limits of n can lie, for example, e.g. in this order, at most at 1.7, 1.65, 1.6, 1.55, 1.5 and 1.45. In various embodiments, $n_{Hk} \leq n_{zw} \leq n_{Ok}$.

In various embodiments, between the light emission surface and the optical moderate light input surface, there is therefore arranged an intermediate layer, e.g. a joining layer holding the optical body on the LED module, for example made of silicone adhesive.

Now to the optical body itself: in various embodiments, an optical body light exit surface, at which the light passing through the optical body emerges, has a continuously convex form, and is therefore curved convexly overall. In the case of a planar optical body light entry surface, the optical body then has the form of a planar convex lens, for example. At the optical body light exit surface under discussion, "at least a large part" of the light passing through the optical body emerges, that is to say e.g. more than 70%, 80% or 90%; e.g., all of the light emerges at the continuously convexly curved optical body light exit surface; in other words there is no optical body light exit surface with another curvature.

In various embodiments, the optical body has a total reflection surface and is arranged relative to the light source in such a way that part of the light passing through the optical body is reflected totally at the total reflection surface and is distributed toward the side.

In various embodiments, the total reflection surface is conical; it therefore has the shape of the outer surface of a cone or corresponding truncated cone with its tip pointing toward the light source; here, a rectilinear cone or truncated cone may be provided, the total reflection surface being e.g. a rotational surface with the main beam as axis of symmetry. The conical shape is e.g. the total reflection surface therefore tapers off toward the light source within the context of the technical possibilities. In various embodiments, the total reflection surface therefore corresponds to the outer surface of a right cone that is rotationally symmetrical about the main beam and has its tip facing the light source.

In various embodiments, e.g. in combination with a (truncated) conical shape just described, the extent of the total reflection surface is provided perpendicular to the main beam and arranged relative to the light source such that it covers the light source in the direction of the main beam. This means that each connecting line parallel to the main beam between light emission surface (of the light source) and diffuser passes through the total reflection surface.

It may also be provided (and specifically also irrespective of the lateral extent just discussed of the total reflection surface) that, for all the connecting lines parallel to the main beam between light emission surface (of the light source)

and diffuser which pass through the total reflection surface, the total reflection condition is satisfied.

Further possible is a simple structure of the optical body to the extent that the conical total reflection surface merges, at its end distal to the light source, into a light exit surface which extends slightly conically or preferably cylindrically around the main beam. In various embodiments, the exit surface and the total reflection surface adjoin each other in an edge running around circularly. At the exit surface, the light reflected at the total reflection surface can then emerge, but also light emitted by the light source at larger polar angles but previously not reflected. The lighting device may have a lighting device reflection surface which reflects at least some of the light emerging from the optical body in the direction of the diffuser. This lighting device reflection surface is conical, specifically having the shape of the outer surface of a truncated cone, and is arranged such that it widens away from the light source toward the diffuser.

By way of example, the exemplary total reflection surface and the lighting device reflection surface have approximately the same slope with respect to the main beam but respective normals to the two surfaces in the same sectional plane containing the main beam should be tilted by no more than 10°, e.g. no more than 5°, with respect to one another (normals which lie on the same side of the main beam and both have a directional component in the direction of the latter are compared).

The lighting device reflection surface has, for example, a reflectivity of at least 80%, e.g. in this order at least 85%, 90%, 95%, 97%, 98% or 99%, specifically in each case on average over the visible range. In general, the lighting device reflection surface can also be provided so as to be diffusely reflective, for example made of a plastic material such as polycarbonate with e.g. white colored pigments embedded therein.

With regard to the efficiency of the lighting device, however, a specularly reflecting reflection surface may be provided, for example made of a material based on silver, e.g. of highly pure silver. In addition, an oxide layer or a corresponding layer system can be applied to a layer of extremely pure silver.

In various embodiments, uses of a corresponding lighting device are provided, specifically for general lighting, preferably for building lighting, particularly preferably for interior lighting, i.e. for lighting in the interior of a building.

FIG. 1 shows a lighting device 1 in a sectioned oblique view and thus also illustrates the structure thereof overall. Arranged on an LED (light emitting diode) module 2 explained further in detail by using FIG. 3 is an optical body 3 made of polycarbonate, specifically in direct optical contact with a light emission surface 4 of the LED module 2. The light emitted by the light source 2 in Lambertian form about a main beam 5 at the light emission surface 4 enters the optical body 3 at an optical body light entry surface 6 and is then partly totally reflected at a total reflection surface 7, in order then to emerge laterally out of the optical body at a light exit surface 8. In the process, however, not all of the light falling onto the total reflection surface 7 is totally reflected, instead the latter also transmits some, specifically light which strikes the total reflection surface 7 with an angular tilt $\theta<\theta_c$ (with respect to a surface normal). The dimensions of the emission surface 4 correspond approximately to the optical body light entry surface 6, and it is possible, for example, for emitted light tilted obliquely upward in the direction of the main beam 5 to strike the total reflection surface 7 substantially perpendicularly and pass through the same.

Figure 2:
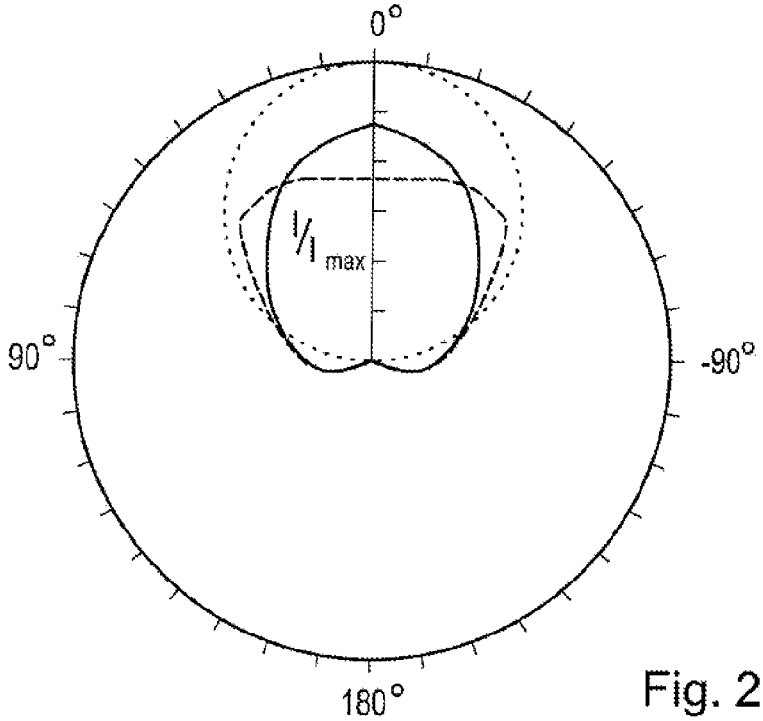
FIG. 2 shows light distribution curves of the light downstream of different optical bodies and, for comparison, a light emission surface without optical body.

FIG. 2 illustrates the emission characteristic of a light source 2 provided with the optical body 3 according to FIG. 1 by using light distribution curves. The luminous intensity in the far field is therefore plotted in a polar diagram, the 0° axis coinciding with the main beam 5. The dashed line corresponds to the light distribution downstream of the optical body 3 according to FIG. 1; for the purpose of comparison, the Lambertian emission characteristic of the light source 2 on its own is shown dotted.

With the optical body 3, the luminous intensity along the main beam 5 and in a polar angular range around the same is therefore attenuated and the light is distributed toward the side.

Figure 4:
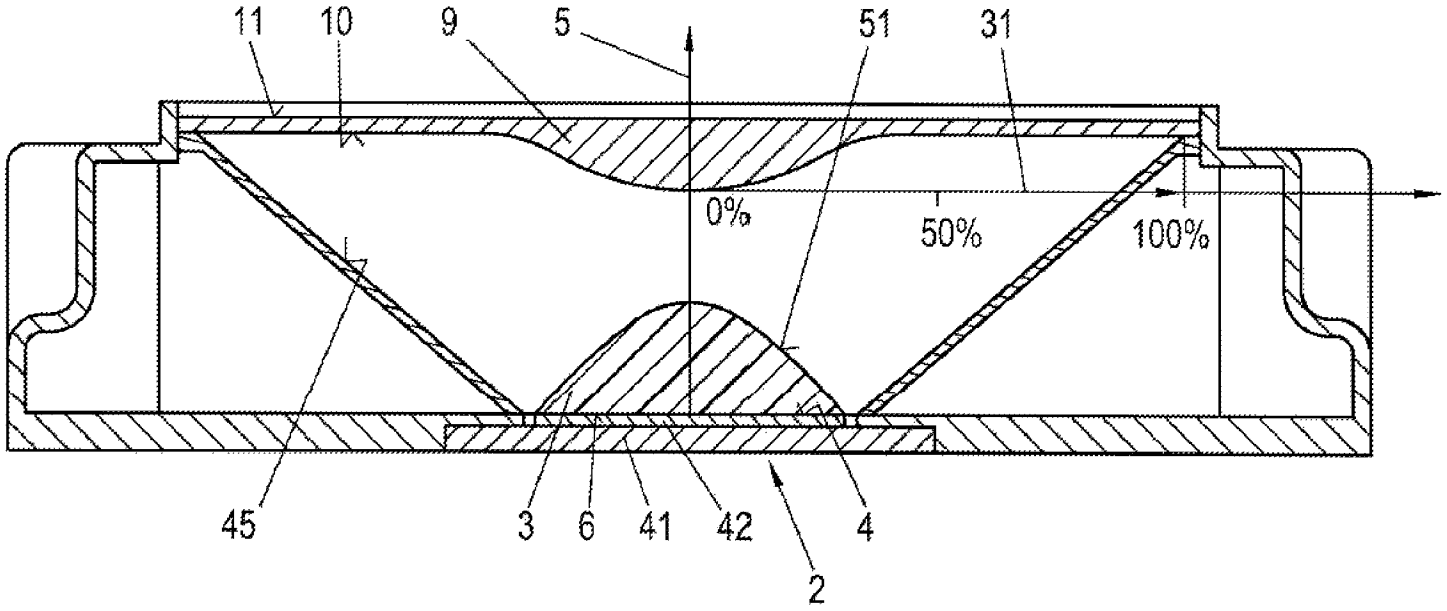
FIG. 4 shows a further lighting device according to various embodiments in a sectioned side view.

The continuous curve, likewise deviating from the Lambertian circular form, reproduces the light distribution from an optical body 3 according to FIG. 4, that is to say an optical body with a convex optical body light exit surface 51 (cf. FIG. 4 and the following description in detail). With this optical body, too, light is distributed toward the side, cf. the deviation from the Lambertian emission characteristic at angles >80% and <−80%. The output coupling efficiency is also increased, although this cannot readily be seen from FIG. 2. This is because the proportions around the polar angles +/−90° can contribute more to the luminous flux output overall than, for example, that at small angles, since, integrated over the revolution, they can result in a greater volume. Provided downstream of the optical body 3 is a diffusely scattering diffuser 9, onto the light entry surface 10 of which the light falls, in order then to be output at the light exit surface 11. The latter represents the light emission surface of the lighting device 1, for which reason the most uniform illumination intensity possible is desired there.

In the event of illumination solely with the LED module 2, because of the Lambertian emission characteristic of the latter, the luminous intensity on the light entry surface 10 and, accordingly, also on the light exit surface 11 would be very non-homogeneous. Therefore, firstly light is distributed somewhat toward the side just with the optical body 3. However, the inventors have established that in order to achieve a uniform luminous intensity of the light entry surface 10, the optical body 3, measured in the direction of the main beam 5, would have to be stretched considerably higher, so that therefore the lighting device 1 overall would not have such a flat structure as then shown in the figures.

Therefore, the homogenization of the luminous intensity at the outlet surface 11 is not set solely via the optical body 3, but instead the diffuser 9 is additionally provided so as to be thicker in a central region and variable in its thickness. Embedded in the diffuser 9 are statistically distributed titanium dioxide particles, so that light falling centrally onto the light entry surface 10 therefore "sees" more scattering centers; therefore the scattering coefficient along the main beam 5 and at small polar angles is large and decreases with increasing polar angle. As a result, along the main beam 5 and at small polar angles thereto, light falling onto the light entry surface is scattered more intensely, therefore attenuated.

The precise course of the scattering will be explained further in detail by using FIG. 3. The diffuser 9 has a lateral extent 31 at right angles to the main beam 5 and is provided in such a way that light falling onto the light entry surface 10 in the inner 50% of the lateral extent 31 is scattered more intensively, on average by about 50%, than light falling thereon in the outer 50% (between 50 and 100%). This means that, therefore, the thickness in the middle, in each case measured parallel to the main beam 5, is correspondingly greater than at the edge (the average thickness in the inner 50% is accordingly about 50% greater than the average thickness in the outer 50%).

In an edge region, from about 40%, the diffuser 9 has a constant thickness. There, light falling onto the light entry surface 10 is therefore scattered location-independently; the scattering coefficient is constant over the region.

The inventors have established that, with this combination of diffuser 9 with curved central and thin edge region and the optical body 3, it is possible to achieve a high efficiency, at the same time the installation height remaining low, therefore the lighting device 1 remaining compact.

The LED module 2 can also be seen schematically in FIG. 3, specifically a carrier plate 41, on which the LEDs (not shown) are arranged. The LEDs are housed jointly with an enveloping body 42 made of silicone, that is to say encapsulated in a silicone potting compound. The surface thereof that is opposite the carrier plate 41 represents the light emission surface 4 of the LED module 2.

The light downstream of the LED module 2 passing through the optical body 3 falls only partly directly onto the light entry surface 10; specifically another part is firstly reflected at the lighting device reflection surface 45. This is provided as a coating of highly pure silver and it reflects the light falling thereon specularly in the direction of the light entry surface 10. The lighting device reflection surface 45 is a rotational surface, and is specifically rotationally symmetrical with respect to the main beam 5; the form corresponds to that of the outer surface of a truncated cone.

FIG. 4 shows a lighting device 1 which, apart from the optical body 3, corresponds to the lighting device explained by using FIGS. 1 and 3. Therefore, e.g. the LED module 2 and the diffuser 9 are structurally identical and, in order to guide the light, a lighting device reflection surface 45 is likewise provided downstream of the optical body 3, reflecting the light specularly toward the light entry surface 10. Reference is made to the above description.

In the lighting device 1 according to FIG. 4, however, no optical body 3 with a conical total reflection surface 7 is provided; instead an optical body light exit surface 51, which is located opposite the optical body light entry surface 6, is provided as a convexly curved surface. This optical body 3 is also provided in direct optical contact with the light emission surface 4 of the LED module 2, which may offer efficiency advantages. The distribution of the light toward the side is not carried out by total reflection in this case, however (at least primarily), but instead the light is refracted as it emerges from the optical body light exit surface 51 and is distributed by the refraction.

When the LED module 2 is considered on its own with the optical body 3 with convexly curved optical body light exit surface 51, the result is the emission characteristic illustrated in FIG. 2; the luminous flux is therefore increased in any case at angles >80%/<−80%, which means that light is distributed toward the side. With regard to the homogenization of the irradiation intensity at the light exit surface 11 of the diffuser 9, to this extent there therefore results a comparable interaction between the two components "optical body 3" and "diffuser 9".

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting device, comprising:

an optoelectronic light source, which is designed for the emission of light around a main beam;

an at least partially translucent optical body for distributing the light; and a diffusely scattering diffuser having a light entry surface and a light exit surface;

wherein the optical body is provided and arranged in such a way that at least a large part of the light emitted by the optoelectronic light source passes through the optical body, part of this light being distributed toward the side of the lighting device;

wherein the diffuser is provided with an inert scattering means and is arranged relative to the light source and the optical body such that a thickness of the diffuser, measured in the direction of the main beam, is smaller than a respective lateral extent of the diffuser which is respectively measured from the main beam at right angles thereto;

at least a large part of the light that has emerged from the optical body falls on the light entry surface, passes through the diffuser and emerges from the diffuser at the light exit surface;

the average scattering of light which falls onto the light entry surface in the inner 50% of a respective side extent of the diffuser is at least 10% greater than the average scattering of light which falls on the light entry surface in the outer 50% of the respective side extent; and at least light which falls onto the light entry surface in the outer 20% of a respective side extent is scattered in a location-independent manner.

2. The lighting device of claim 1, wherein the diffuser is provided and is arranged relative to the light source and the optical body such that the scattering of the light decreases away from the main beam, wherein the course of the scattering being continuous and smooth.

3. The lighting device of claim 1, wherein an optical body projection area represents a sub-region of the light entry surface;

wherein optical body projection area results from a projection of the optical body in the direction of the main beam onto the light entry surface;

wherein the average scattering of light which falls onto the optical body projection area being at least 10% greater than the average scattering of light which falls onto the light entry surface outside the optical body projection area.

4. The lighting device of claim 3, wherein the light entry surface is divided into an adaptation region;

wherein light falling thereon is scattered in a location-dependent manner, and transmission region;

wherein light falling thereon is scattered in a location-independent manner; wherein the adaptation region and the optical body projection area are congruent or behave in relation to each other like a superset and subset and, in the last-named case, differ in their area content by at most 15%, based on the smaller area.

5. The lighting device of claim 1, wherein the scattering means are provided as scattering particles embedded in the diffuser.

6. The lighting device of claim 5, wherein the average thickness of the diffuser is greater in the inner 50% of the lateral extent than the average thickness in the outer 50% of the lateral extent.

7. The lighting device of claim 6, wherein an optical body projection area represents a sub-region of the light entry surface;

wherein optical body projection area results from a projection of the optical body in the direction of the main beam onto the light entry surface;

wherein the average scattering of light which falls onto the optical body projection area being at least 10% greater than the average scattering of light which falls onto the light entry surface outside the optical body projection area;

wherein the percentage statements relating to the scattering are established solely by a thickness fluctuation that is proportional thereto.

8. The lighting device of claim 1, wherein the light exit surface of the diffuser is planar.

9. The lighting device of claim 1, wherein the light source and the optical body are provided and arranged in such a way that when only the two are considered, the light downstream of the optical body has a light distribution in which, starting from the main beam as 0° axis, the luminous intensity has a maximum value in a polar angular range between −60° and 60° and at −90° and 90° still makes up at least 10% but at most 60% of the maximum value.

10. The lighting device of claim 1, wherein the light source has a light emission surface and the optical body is an optical body light entry surface;

wherein the light emission surface and the optical body light entry surface are provided in direct optical contact, that is to say, if need be, the light between the two passes through an intermediate material with a refractive index $n_{zw} \geq 1.2$.

11. The lighting device of claim 1, wherein at least a great part of the light passing through the optical body emerges at an optical body light exit surface, which runs in a continuously convexly curved manner.

12. The lighting device of claim 1, wherein the optical body has a total reflection surface for the partial transmission and partial reflection of light;

wherein the light source and the optical body are arranged relative to each other in such a way that part of the light passing through the optical body is reflected totally at the total reflection surface and is distributed toward the side.

13. The lighting device of claim 12, wherein the total reflection surface is conical and widens away from the light source.

14. The lighting device of claim 12, wherein the light source has a light emission surface and the total reflection surface is provided and arranged such that it covers the light emission surface completely in the direction of the main beam.

15. The lighting device of claim 1, further comprising:

a lighting device reflection surface which is arranged relative to the optical body and the diffuser such that it reflects at least part of the light passing through the optical body onto the light entry surface of the diffuser, which lighting device reflection surface is conical.

* * * * *